United States Patent [19]

McCollum et al.

[11] Patent Number: 4,900,249

[45] Date of Patent: Feb. 13, 1990

[54] ALUMINUM REVERBERATORY FURNACE LINING

[75] Inventors: John M. McCollum, Wexford; John N. Snyder, Bentleyville, both of Pa.

[73] Assignee: Dresser Industries, Inc., Dallas, Tex.

[21] Appl. No.: 2,325

[22] Filed: Jan. 12, 1987

[51] Int. Cl.[4] ..... F27B 14/08

[52] U.S. Cl. ..... 432/248; 110/336; 266/283; 373/137; 373/155; 373/162

[58] Field of Search ..... 373/155, 162, 137; 266/280, 283; 110/336; 432/248, 264

[56] References Cited

U.S. PATENT DOCUMENTS

| | | | |
|---|---|---|---|
| 3,779,699 | 12/1973 | Russell et al. | 432/248 |
| 3,953,007 | 4/1976 | van Laar | 266/280 X |
| 4,130,391 | 12/1978 | Boggum et al. | 110/336 X |
| 4,286,529 | 9/1981 | Musser | 110/336 X |
| 4,526,351 | 7/1985 | La Bate | 266/283 X |
| 4,537,671 | 8/1985 | Zollinger et al. | 373/137 X |

*Primary Examiner*—Edward G. Favors

*Attorney, Agent, or Firm*—Sigalos, Levine & Montgomery

[57] ABSTRACT

A lining for use in an aluminum reverberatory furnace or the like for heating molten aluminum in a cavity which cavity is formed by a roof, sidewalls and a bottom which are to be lined with refractory materials. The lining comprises a band of hot face refractory material around the interior periphery of the cavity sidewalls for contacting molten aluminum in the furnace at the normal operating levels of the upper surface of the molten aluminum. A layer of backup refractory material is interposed between the furnace shell and the band of hot face refractory material.

11 Claims, 1 Drawing Sheet

ALUMINUM REVERBERATORY FURNACE LINING

BACKGROUND OF THE INVENTION

The invention relates to a refractory lining for use in an aluminum reverberatory furnace or the like for heating molten aluminum.

DESCRIPTION OF THE PRIOR ART

Refractory materials have been used to line aluminum reverberatory furnaces. Normally the lining must withstand high temperatures and must have high resistance to the transfer of heat. Also special problems of mechanical wear and deterioration due to impregnation with corrosive elements often occur at the interface between the molten aluminum and the gaseous atmosphere in the furnace. There is a region of the lining or a band around the belly of the furnace extending from above the normal operating level of molten aluminum in the furnace to below the normal operating level of aluminum in the furnace at which the wear and corrosive effects are most prevalent.

Impurities in the aluminum which are lighter than the metal float or migrate to the upper surface level of aluminum. Also oxidation takes place at the upper interface between the molten aluminum and the atmosphere in the reverberatory furnace. As a result the belly band region of the furnace is subject to a highly corrosive environment. Also, the oxidation, scale and other impurities are removed from the furnace using metal/dross removal equipment which mechanically wears the lining in the belly band region. Basically this equipment is a large metallic scrapper which is used to skim off the impurities from the top of the molten metal. In the course of this skimming process the dross removal equipment or the scrapper inevitably impacts, scrapes, and otherwise wears against the refractory lining material in the belly band region.

As a result the belly band refractory material "wears out" sooner than the upper or lower wall refractory lining. The use of hi-strength, corrosion resistant refractory materials prolongs the life of the lining but is expensive, therefore multiplying the waste due to serviceable upper and lower walls which are replaced when the belly band region is no longer useable. Also, the more expensive refractory materials which are more resistant to corrosion and more resistant to wear tend to have reduced insulative characteristics and therefore do not provide a practical alternative for standard refractory brick materials.

SUMMARY OF THE INVENTION

The present invention provides a lining for use in an aluminum reverberatory furnace or the like for heating molten aluminum in a cavity which cavity is formed by a roof, sidewalls and a bottom which are to be lined by refractory materials. The inventive lining comprises a band of hot face refractory material around the interior periphery of the cavity sidewalls for contacting molten aluminum in the furnace at the normal operating levels of the upper surface of the molten aluminum. The hot face refractory shapes are designed to reduce the number of horizontal joints in the belly band region. A layer of backup refractory material is interposed between the furnace shell and the band of hot face refractory material.

BRIEF DESCRIPTION OF THE DRAWINGS

The present invention has provided a refractory lining which eliminates and reduces the foregoing and other associated problems with the prior art as may be more fully understood with reference to the following drawings in which.

DETAILED DESCRIPTION OF THE DRAWINGS

Figure 1:
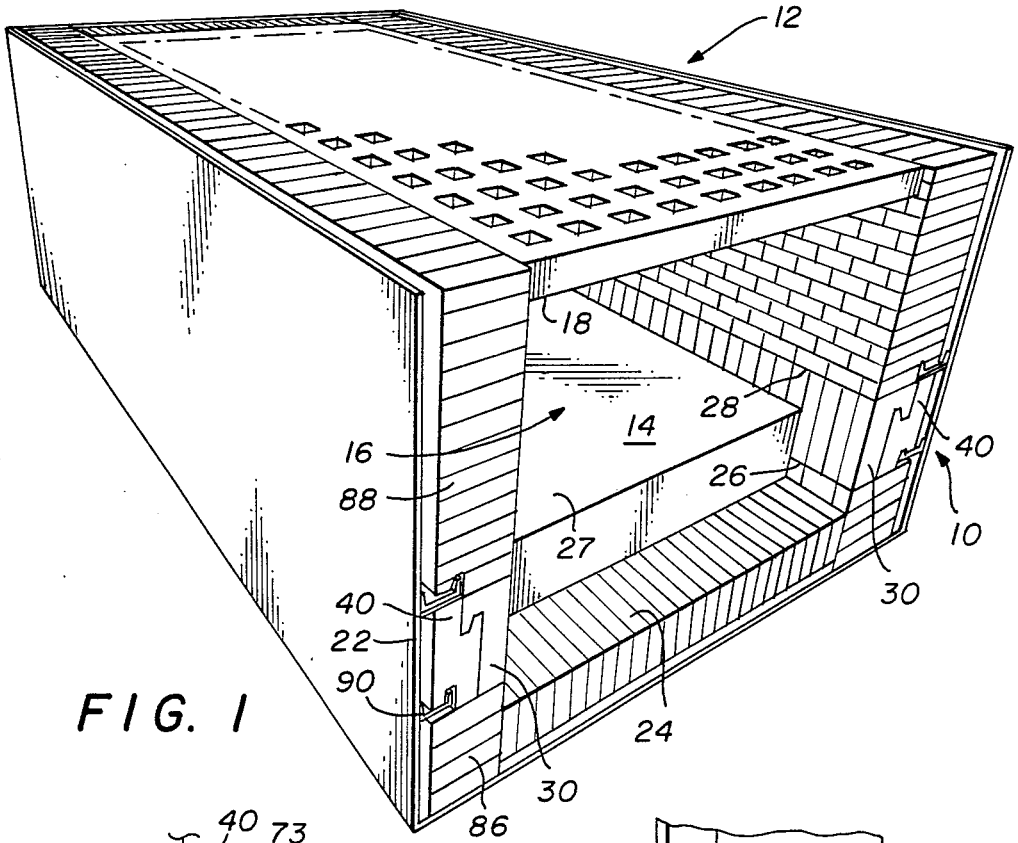
FIG. 1 is a perspective view of an aluminum reverberatory furnace with the inventive lining in place.

The invention may be more fully understood with reference to the drawings in which FIG. 1 is a perspective view which shows a lining 10 for use in an aluminum reverberatory furnace 12 or the like for heating molten aluminum 14. In this view, it will be understood that the furnace is shown with the end closure removed and with the molten aluminum in place as if the furnace was interrupted instantaneously during normal operation. A cavity 16 is formed by a roof 18, sidewalls 22, and a bottom 24 to be lined with refractory material. The inventive lining 10 comprises a band 30 of hot face refractory material around the interior periphery of the hearth sidewalls 22. The hot face refractory material is positioned at the belly band for contacting molten aluminum 14 in the furnace 12 at the normal operating levels of the upper surface 27 of the molten aluminum 14. Preferably the band 30 extends vertically for about thirty inches (about 76.2 centimeters) from six to eight inches (15.2 to 20.3 centimeters) above at 28 the normal maximum operating level to twenty-four to twenty-two inches (61.0 to 55.9 centimeters) below at 26 the highest maximum operating level, which is below the lowest normal operating level. Interposed between the sidewalls 22 and the band 30 of hot face refractory material is a layer 40 of backup refractory material. This layer is also about thirty inches (76.2 centimeters) tall and substantially coterminous with the hot face band 30.

In the preferred embodiment, the band 30 of hot face refractory material is not as thick as the upper 88 or lower 86 sidewalls. The refractory material of the band 30 in the preferred embodiment is harder and thus more wear resistant than the upper or lower lining. The refractory material of band 30 is preferably more impervious to impregnation by molten aluminum than the material used for the upper 88 and lower 86 sidewall linings. It has been found that suitable materials for these purposes include refractory compositions based on 85% alumina phosphate bonded material, magnesia-alumina spinel material, fused and/or calcined bauxite material, clay bonded silicon carbide, silicon oxynitride bonded silicon carbide, silicon nitride bonded silicon carbide, sialon bonded silicon carbide and the like, and mixtures thereof.

Figure 2:
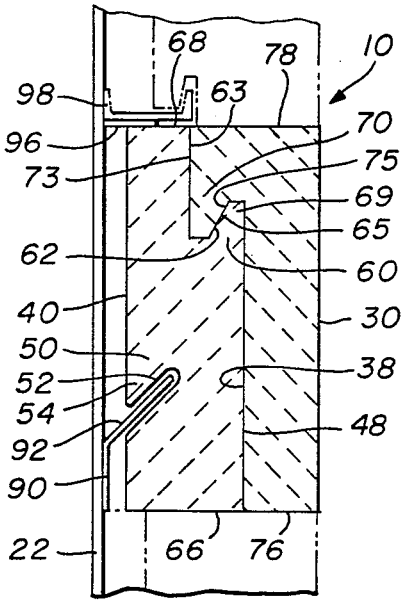
FIG. 2 is a partial cross-sectional end view of the inventive lining.

As will further be understood with reference to FIGS. 1 and 2, the layer 40 of backup refractory material is also thinner than the upper 88 and lower 86 sidewall linings and is interposed between the band 30 of hot face refractory material and the interior sidewalls 22 of the furnace such that the combined thickness of the band 30 and the backup layer 40 is substantially equal to the thickness of the upper and lower lining material. In the preferred embodiment the backup layer is made of a less expensive refractory material than is the hot face band. With this invention the backup layer 40 can be softer than the hot face band 30. It has been found that suitable refractory material for the backup layer includes magnesia-alumina spinel material, fused and/or calcined bauxite material, high alumina materials and the like materials, and mixtures thereof.

Advantages of the refractory lining 10 of the present invention include reduced cost because only a thin layer of expensive hard, wear resistant material is used in the belly band region where lining deterioration is most rapid. The refractory lining 10 has fewer horizontal joints thereby reducing metal penetration. Thus the life of the furnace lining is improved at a minimum cost. Expensive material is used only where it is needed.

Figure 3:
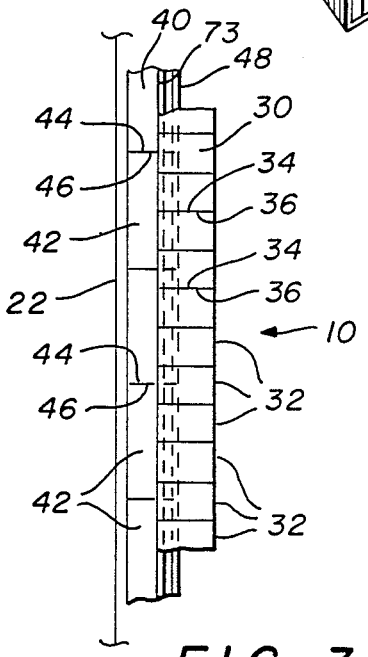
FIG. 3 is a partial schematic top view of the inventive belly band lining.

As will further be understood with reference to FIG. 3 the preferred embodiment of band 30 of hot face refractory material comprises multiple hot face blocks 32 arranged substantially abutted end 34 to end 36 of each block around the interior periphery of the cavity 16.

Similarly, in the preferred embodiment the layer 40 of backup refractory material comprises in the preferred embodiment multiple backup blocks 42 arranged substantially abutted end 44 to end 46 around the periphery of the band 30 of hot face blocks 32 and interposed between the band 30 of hot face blocks 32 and the sidewalls 22.

The use of the block construction provides for easy maintenance, replacement, and construction of the inventive belly band lining. Further, problems associated with molding large sections of refractory material are reduced. Also the block construction can reduce difficulties associated with heat expansion of the materials such as stress cracking when the furnace is heated rapidly. Thus with the use of blocks for the hot face band and for the backup layer results in an optimization of the rate by which the furnace can be brought up to operating temperatures.

In the preferred embodiment, as may best be understood with reference to FIG. 2, there is a means 50 formed on the layer 40 of backup refractory material adjacent the sidewalls 22 for receiving vertical support from the sidewalls. Means 50 also provides lateral support from sidewalls 22 so that lining or block movement into and out of the hearth is not permitted. There is a means 60 formed on the layer of backup refractory material for providing vertical and also lateral support to the band 30 of hot face refractory material. Correspondingly there is means 70 formed on the band 30 of hot face refractory material adjacent the layer 40 of backup refractory material for receiving vertical and lateral support therefrom.

There is a means 90 on the interior of the sidewalls for vertically supporting the layer of backup refractory material. Means 90 may in the preferred embodiment comprise a rigid projection 92 fastened to the interior sidewalls 22 and extending around the interior periphery of the sidewalls 22. Preferably projection 92 has a portion thereof which is angled with the top thereof away from the sidewalls. There may also be a flange 96 rigidly connected to the sidewall 22 spaced apart from projection 92 and extending horizontally around the interior periphery of the sidewalls for contacting an upper surface, such as upper surface 68, of backup layer 40 to provide added lateral support to backup layer 40. Such a flange 96 can prevent the backup blocks of layer 40 from pivoting into the cavity. Further, extending from the sidewalls may be a means 98 for providing support to the upper refractory lining thereby independently supporting the upper wall lining to reduce the weight carried by means 90 and the belly band lining 10. Also means 98 facilitates replacement or repair of the belly band lining 10 independent of replacement or repair of the upper sidewall lining 88. Likewise, independently supporting the belly band lining 10 through means 90, 50, 60 and 70 facilitates replacement or repair of the hot face band 30, blocks 32 and/or the backup layer 40, blocks 42 of the belly band lining without removal of the lower sidewall lining.

The means 50 on backup layer 40 for receiving vertical support from the sidewalls comprises a first channel 52 formed in the backup layer 40 or formed in each block 42 of the backup layer on the side thereof adjacent the sidewall 22. The channel 52 has a downturned lip 54 for correspondingly overlapping engagement with the upturned projection 92. In the preferred embodiment, channel 52 is formed during the manufacture of the backup layer 40 or each backup block 42 a by casting such blocks with channel 52 integrally formed. It extends along the length of the backup layer 40 or along the length of each block 42 adjacent the side thereof which is adjacent the sidewall 22. Preferably, the removed portion of the material or the channel 52 at the lower side of backup layer 40 or each block 42 to permit the projection 92 to extend thereinto. Preferably the surface of the first horizontal channel 52 which is nearest downturned lip 54 is angled toward the sidewall for corresponding ramp engagement with the upper angled surface of projection 92. This construction provides for ease of assembly and increases the rigidity of the assembled lining.

The structure of means 60 for providing vertical and lateral support to band 30 of hot face refractory material comprises, in the preferred embodiment, at least a portion of layer 40 of backup material which forms a second horizontal channel 62 adjacent the band 30 of hot face refractory material. The second horizontal channel 62 is formed by a first substantially vertical surface 63 forming one side of the second channel 62 extending down from the top 68 of the backup layer 40 a distance less than the total height of the backup layer. The second horizontal channel 62 is further formed by a second vertical surface 48 substantially parallel to the first vertical surface 63, which second vertical surface extends up from the bottom 66 of the backup layer 40 a second distance less than the total height of the backup layer 40. The second vertical surface 48 is offset from the first vertical surface 63 a lateral distance sufficient to provide enough material thickness for mechanical strength required for support to the hot face band. This distance is dependent upon the material characteristics of the refractory material being used for the backup block and also upon the weight of the hot face band which it will be required to support. The horizontal channel 62 is further formed by a connecting surface 65 between the first and second vertical surfaces 63 and 48 which surface 65 has at least a portion thereof which is angled away from the first vertical surface 63. Connecting surface 65 preferably extends from the lowest extent of the first vertical surface 63 to the highest extent of the second vertical surface 48. It will be understood with reference to FIG. 2 that the connecting surface 65 may also have substantially horizontal portions on either end of the angled portion depending upon the lateral distance between the first 63 and second 48 vertical surfaces and the angle of such portion.

Means 70 on the band 30 of hot face refractory material for receiving vertical and lateral support comprises a portion of the band of hot face refractory material which forms a projection 72 sized for corresponding overlapping engagement into the second horizontal channel 62. Preferably, the adjacent surfaces 48 and 38 and the adjacent surfaces 63 and 73, as will be more fully described below, will be substantially in abutting contact when the corresponding projection 72 and the second horizontal channel 62 are engaged.

Thus, as will be understood with reference to FIG. 2, the hot face band projection of the preferred embodiment is formed by a third vertical surface 73 extending down from the top 78 of the hot face band 30 or, as the case may be, a third vertical surface 73 extends down from the top 78 of hot face blocks 32, a distance substantially equal to the first distance of the first vertical surface 63 of the backup layer 40 or backup blocks 42 forming said layer. A fourth vertical surface 38 extends up from the bottom 76 of the hot face band 30 or block 32 a distance substantially equal to the second distance of the second vertical surface 48 of the backup layer 40 or block 42. There is an interposed surface 75, a portion of which is correspondingly angled and positioned for contacting the angled portion of the connecting surface 65 of the second horizontal channel 62 when the first vertical surface 63 is in contact with the third vertical surface 73 and when the second vertical surface 48 is in contact with the fourth vertical surface 38. Further, interposed surface 75 may comprise horizontal surfaces on either end thereof corresponding to the horizontal surfaces of connecting surface 65.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

We claim:

1. A lining for use in an aluminum reverberatory furnace or the like for heating molten aluminum in a cavity formed by a roof, sidewalls and a bottom to be lined with refractory material, said lining comprising:

a. a band of hot face refractory material around the interior periphery of said cavity sidewalls for contacting molten aluminum in said furnace at the normal operating levels of the upper surface of said molten aluminum; and b. a layer of backup refractory material interposed between the sidewalls and the band of hot face refractory material.

2. The lining of claim 1 wherein said band of hot face refractory material comprises multiple hot face blocks arranged substantially abutted end to end around the interior periphery of said cavity and means for independently supporting said hot face blocks such that said blocks are replaceable without replacing said layer of backup refractory.

3. The lining of claim 2 wherein said layer of backup refractory material comprises multiple backup blocks arranged substantially abutted end to end around the periphery of said band of hot face blocks and interposed between said band of hot face blocks and said sidewalls.

4. The lining of claim 1 further comprising:

a. upper sidewall lining and lower sidewall lining above and below said normal furnace operating levels to which said band of hot face material extends;

b. means formed on said layer of backup refractory material adjacent said sidewalls for receiving vertical and lateral support from said sidewalls independent of said upper sidewall lining and lower sidewall lining portions;

c. means formed on said layer of backup refractory material for providing vertical and lateral support to said band of hot face refractory material independent of said upper sidewall lining and lower sidewall lining portions; and d. means formed on said band of hot face refractory material adjacent said layer of backup refractory material for receiving vertical and lateral support therefrom independent of said upper sidewall lining and lower sidewall lining portions, thereby facilitating replacement of said hot face refractory material.

5. The lining of claim 4 wherein:

a. said means on said layer of backup refractory material for receiving lateral and vertical support from said sidewalls comprises at least a portion of said layer of backup material which forms a first channel adjacent said sidewall;

b. said means for providing lateral and vertical support to said band of hot face refractory comprises at least a portion of said layer of backup material which forms a second horizontal channel adjacent said band of hot face refractory material; and c. said means formed on said band of hot face refractory material for receiving vertical and lateral support comprises a portion of said band of hot face refractory material forming a projection sized for corresponding overlapping engagement into said second horizontal channel such that the adjacent surfaces of said backup layer and said hot face band are substantially in abutting contact when said corresponding projection and second horizontal channel are engaged.

6. A lining as in claim 5 wherein:

a. said second horizontal channel of said backup layer is formed by a first surface forming one side of said second channel extending down from the top of said backup layer a first distance less than the total height of said backup layer, a second surface extending up from the bottom of said backup layer a second distance less than the total height of said backup layer such that the top of said second surface is offset from the bottom of said first surface a lateral distance sufficient to provide mechanical strength required for support to said hot face band and a connecting surface comprising another side of said channel angled away from said first surface and extending up from the lowest extent of said first surface to the highest extent of said second surface; and b. said hot face band projection is formed by a third surface extending down from the top of said hot face band a distance substantially equal to said first distance of said first surface, a fourth surface extending up from the bottom of said hot face band a distance substantially equal to said second distance of said second surface, and an interposed surface correspondingly angled and positioned for contacting said angled side of said backup block second channel when said first surface is in contact with said third surface and when said second surface is in contact with said fourth surface.

7. A lining as in claim 1 wherein said hot face refractory material is selected from refractory compositions based on 85% alumina phosphate bonded material, magnesia-alumina spinel material, fused and/or calcined bauxite material, clay bonded silicon carbide, silicon oxynitride bonded silicon carbide, silicon nitride bonded silicon carbide, sialon bonded silicon carbide and the like, and mixtures thereof.

8. A lining as in claim 1 wherein said backup block refractory material is selected from magnesia-alumina spinel material, fused and/or calcined bauxite material, or mixtures thereof.

9. A lining as in claim 3 wherein said hot face refractory material is selected from refractory compositions based on 85% alumina phosphate bonded material, magnesia-alumina spinel material, fused and/or calcined bauxite material, clay bonded silicon carbide, silicon oxynitride bonded silicon carbide, silicon nitride bonded silicon carbide, or sialon bonded silicon carbide, or mixtures thereof.

10. A lining as in claim 3 wherein said backup block refractory material is selected from the group of refractory materials including magnesia-alumina spinel material, fused and/or calcined bauxite material, or mixtures thereof.

11. A lining for use in an aluminum reverberatory furnace or the like for heating molten aluminum in a cavity formed by a roof, sidewalls and a bottom to be lined with refractory material, said lining comprising:

a. a band of hot face refractory material around the interior periphery of said cavity sidewalls for contacting molten aluminum in said furnace at the normal operating levels of the upper surface of said molten aluminum;

b. a layer of backup refractory material interposed between the sidewalls and said band of hot face refractory material;

c. means formed on said layer of backup refractory material adjacent said sidewalls for receiving vertical and lateral support from said sidewalls, including at least a portion of said layer of backup material which forms a first channel adjacent said sidewall;

d. means formed on said layer of backup refractory material for providing vertical and lateral support to said band of hot face refractory material including at least a portion of said layer of backup material which forms a second horizontal channel adjacent said band of hot face refractory material, said second horizontal channel comprising a first surface forming one side of said second channel extending down from the top of said backup layer a first distance less than the total height of said backup layer, a second surface extending up from the bottom of said backup layer a second distance less than the total height of said backup layer such that the top of said second surface is offset from the bottom of said first surface a lateral distance sufficient to provide mechanical strength required for support to said hot face band and a connecting surface comprising another side of said channel angled away from said first surface and extending up from the lowest extent of said first surface to the highest extent of said second surface; and e. means formed on said band of hot face of refractory material adjacent said layer of backup refractory material for receiving vertical and lateral support therefrom, including a portion of said band of hot face refractory material forming a projection sized for corresponding overlapping engagement into said second horizontal channel such that the adjacent surfaces of said backup layer and said hot face band are substantially in abutting contact when said corresponding projection and second horizontal channel are engaged and said hot face band projection is formed by a third surface extending down from the top of said hot face band a distance substantially equal to said first distance of said first surface, a fourth surface extending up from the bottom of said hot face band a distance substantially equal to said second distance of said second surface, and an interposed surface correspondingly angled and positioned for contacting said angled side of said backup block second channel when said first surface is in contact with said third surface and when said second surface is in contact with said fourth surface.

* * * * *